United States Patent [19]

Frochaux

[11] 3,949,828

[45] Apr. 13, 1976

[54] FLUID EXHAUST SILENCER

[75] Inventor: Alain Frochaux, Boston, Mass.

[73] Assignee: Barry Wright Corporation, Watertown, Mass.

[22] Filed: Aug. 30, 1974

[21] Appl. No.: 502,054

[52] U.S. Cl. ..... 181/36 A; 181/36 B; 181/42

[51] Int. Cl.[2] ..... F01N 3/06

[58] Field of Search..... 181/36 A, 36 R, 35 R, 42, 181/50, 56, 60

[56] References Cited

UNITED STATES PATENTS

| | | | |
|---|---|---|---|
| 2,600,236 | 6/1952 | Gibel | 181/36 A |
| 2,815,088 | 12/1957 | Gibel | 181/36 A |
| 3,009,531 | 11/1961 | Mead | 181/36 A |
| 3,208,551 | 9/1965 | Carls | 181/36 A |
| 3,339,668 | 9/1967 | Trainor | 181/36 A |
| 3,547,223 | 12/1970 | Gibel | 181/36 |
| 3,783,590 | 1/1974 | Allen | 181/37 |

*Primary Examiner*—L. T. Hix
*Assistant Examiner*—Vit W. Miska
*Attorney, Agent, or Firm*—Milton E. Gilbert

[57] ABSTRACT

A fluid exhaust silencer is disclosed which comprises a hollow, cylindrical, fluid-permeable noise-reducing element made of a wire mesh material. The noise-reducing element is mounted in a housing which is adapted to be connected to an exhaust for a pressurized fluid. The housing is made so that the pressurized exhaust fluid flows into one end of the housing and is discharged from the side of the housing after passage radially through the noise-reducing element.

10 Claims, 4 Drawing Figures

FLUID EXHAUST SILENCER

This invention relates to suppression of noise in fluid flow systems and more particularly to a novel fluid exhaust silencer.

As is well known in connection with fluid powered machinery, e.g. machinery powered by air, steam or products of combustion, noises are frequently produced which are unacceptable or harmful to human beings. Accordingly in certain jurisdictions governmental regulations have been enacted which set standards with regard to occupational noise exposure. In the U.S.A., for example, the Walsh-Healy Act prescrbies a maximum occupational noise level of 90dBA (90 decibels measured on the A scale of a sound level meter) for continuous exposure of no more than eight hours per day. For these and other reasons it is customary to attach exhaust silencers to equipment to reduce the noise produced by gases passing through orifices or venturis at high speed and pressure. However, for certain applications such as air valves and air-operated tools the silencers must be capable of achieving the desired degree of noise reduction without creating excessive back pressure which will cause slow-down in the operating cycle of the equipment. It also is desirable in certain applications that the air or other fluid be discharged in a diffused pattern rather than as a jet so as not to blow around dust and loose particles such as metal filings.

In copending application Ser. No. 388,636, filed 8/17/73 by Alain Frochaux and Charles M. Salerno, novel fluid discharge devices are disclosed which comprise one or more flow-modifying elements made from knitted metal wire mesh fabric that function to sharply reduce noise levels while permitting air or other fluid to be discharged at a high velocity. Gas discharge devices made as described in said application may take the form of nozzles for discharging air or other fluid as a narrow jet or exhaust devices for discharging air or other fluid in a diffused pattern. In addition to effecting sharp noise reduction while allowing gases to be discharged rapidly in a controlled flow pattern, the fluid discharge devices described in said copending application offer the advantage of heat and corrosion resistance, simplicity of construction, durability and ease of installation.

The primary object of this invention is to provide a novel fluid exhaust silencer which embodies and has substantially all of the advantages of the exhaust device disclosed in said co-pending application and offers the added advantages of reduced cost of manufacture and assembly.

A further object is to provide a fluid exhaust silencer which has a relatively large discharge opening so as to maximize throughput of fluid and discharge the same as a diffused and omni-directional stream.

Still another object is to provide a fluid exhaust silencer which can be made in various sizes and capacities without any change in basic design and can be made so as to avoid or reduce production of noise-producing eddies and vortices.

In accordance with this invention the foregoing objects are achieved by providing a device which essentially consists of only three parts, namely, a bushing member adapted to be connected to a discharge conduit or exhaust port for a pressurized fluid, a hollow noise-reducing element made from a knitted wire mesh fabric, and a cap member which coacts with the bushing member to hold the noise-reducing element in place and define two or more discharge openings through which fluid can pass out of the device via the noise-reducing element.

Other features and many of the advantages of the invention will become apparent from the following detailed description of the accompanying drawing wherein.

In the several figures of the drawing like numerals are used to designate like parts.

Figure 1:
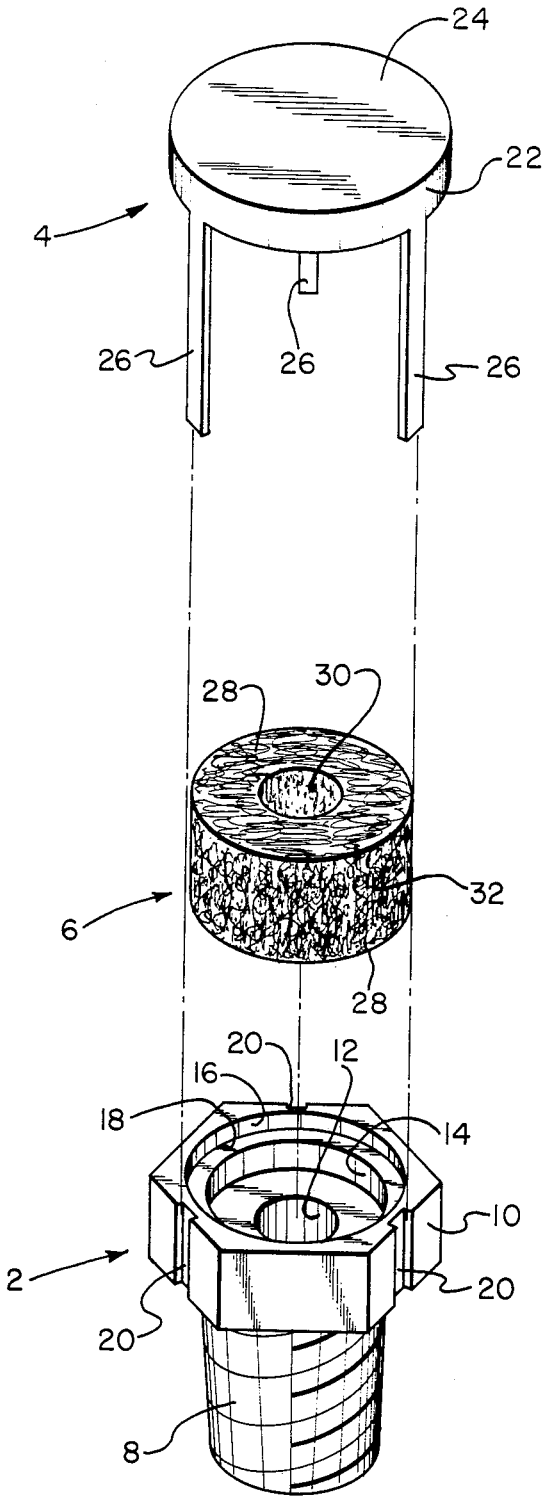
FIG. 1 is an exploded perspective view of a preferred embodiment of the invention.

Referring now to the drawings, the illustrated device comprises a housing consisting of a bushing member 2 and a cap member 4, plus a noise-reducing element 6 captivated in the housing.

The bushing member 2 comprises an adapter section 8 which is externally threaded as shown at 9 for attachment to an exhaust pipe or port of a fluid operated or fluid handling machine, tool, valve body or the like, and a retainer section 10 for holding the noise-reducing element 6. The exterior of retainer section 10 has the shape of a polyhedral nut, preferably a hexagonal nut as shown, for engagement by a suitable wrench or other tool for tightly coupling the device to a machine or other apparatus. It will be appreciated that the exterior of the retainer section may be shaped otherwise than as shown for engagement by a wrench or tool. Bushing member 2 is provided with a smooth-surfaced axial bore 12 which has a constant diameter through its adapter section and is counterbored as shown at 14 and 16 in its retainer section so as to form an annular shoulder 18. Bore 12 and the two counterbores 14 and 16 preferably are annular in cross-section as shown. An additional feature of bushing member 2 is provision of a slot 20 in every other one of the six exterior surfaces of retainer section 10. Slots 20 preferably are formed with flat sides and bottoms with the former intersecting the latter at angles of about 90°.

The cap member 4 is in the form of a cup and comprises a cylindrical side wall 22 closed off at one end by a flat annular end wall 24. Side wall 22 is integral with end wall 24 and is provided with three equally spaced integral legs 26 at its end opposite end wall 24. Legs 26 have flat side edges and have a width slightly less than the width of slots 20. The thickness of legs 26 is preferably the same as the depth of slots 20.

The noise-reducing element 6 is made of a knitted wire mesh fabric. Knitted wire mesh fabric and the method of making the same are well known. In this connection see, for example, U.S. Pat. Nos. 2,334,263; 3,346,302; 2,680,284; 2,869,858 and 2,426,316. In the practice of this invention the knitted wire mesh fabric is preferably made of stainless steel wire, although other steels and alloys also may be used.

The manufacture of the noise-reducing element is preferably made by flattening a knitted wire mesh fabric tube upon itself to form a flat 2-ply ribbon, and then rolling the ribbon upon itself. The ribbon is wound up on a mandrel in the manner shown in FIG. 2 of U.S.

Figure 3:
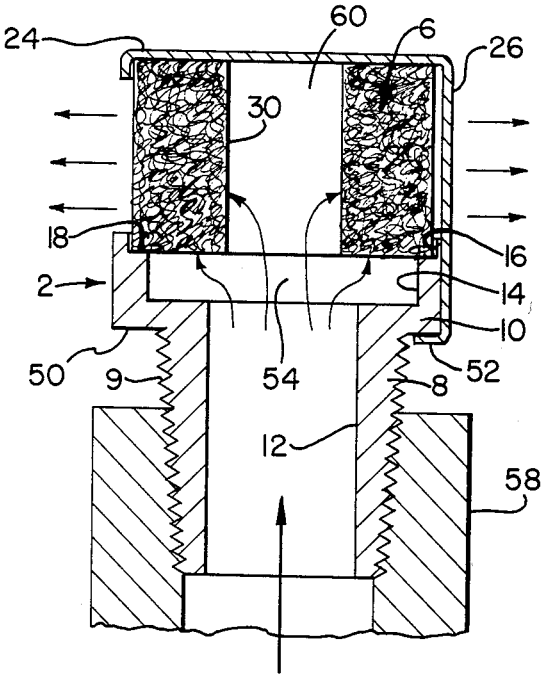
FIG. 3 is a longitudinal sectional view taken along line 3—3 of FIG. 2.

Pat. No. 3,346,302, with the result that the rolled up body has a generally cylindrical shape. The 2-ply ribbon is wound up so that its width, i.e. transverse dimension, extends parallel to the body's longitudinal axis. More specifically, the body consists in cross-section of a continuous spiral convolute. In this generally cylindrical body the lengths of wire making up each turn of the fabric tube are now largely so oriented as to extend from one end of the body to the other in directions generally parallel with the body's longitudinal axis. This cylindrical body is then compressed and molded into a hollow cylindrical noise-reducing element of desired density. As seen in FIGS. 1 and 3, the element 6 has flat annular end surfaces 28 and cylindrical inner and outer side surfaces 30 and 32.

Figure 4:
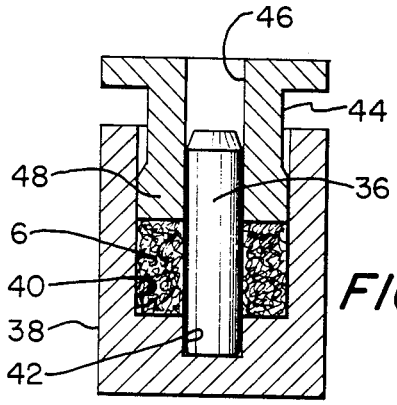
FIG. 4 is a longitudinal sectional view on a reduced scale of apparatus for forming the noise-reducing element.

FIG. 4 illustrates a die apparatus for molding the noise-reducing element 6. The die apparatus consists of a mandrel 36 of annular cross-section on which the flat 2-ply ribbon is wound as previously described, a mold 38 having a cylindrical cavity 40 with a blind hole 42 at the bottom of the cavity for receiving one end of the mandrel, and a piston assembly comprising a piston 44 with a center bore 46 sized to make a telescoping fit with the mandrel and a head 48 for engaging the wound turns of wire mesh ribbon. The die apparatus is mounted in a press (not shown) having a stationary bed to which the mold is secured and a vertically reciprocal pressure head to which the piston assembly is attached. When the press is operated, the piston head forces the wire mesh body down along the mandrel so that it is compressed between the piston and the bottom of the mold cavity. The extent of movement of the piston is set so that the wire mesh body 6 is compressed to a suitable density, e.g. to a density equal to about 50% of the wire material of which the wire mesh fabric is made.

In the preferred embodiment of the invention the noise-reducing element 6 is fabricated from knitted metal wire mesh which may be knitted from wire of selected gauge. The mesh may be knit flat or tubular and may be of selected mesh loop size. Preferably, it is knitted as a tube or sock on a circular knitting machine. In its simplest form, the knitted wire mesh tube may be knitted from a single continuous length of metal wire which is so manipulated as to form a continuous tube in which successive turns of the wire form lengths which extend circumferentially of the tube and are interlocked by stitches. Each length is bent locally beyond its elastic limit as a result of the formation and interlocking of loops or stitches as the tube is knitted. Thus each circumferential length, in effect, forms a flattened spring which may be stretched or compressed. The finished tube or sock is flattened longitudinally so as to form a 2-ply ribbon. Preferably but not necessarily, the flattened tube may be corrugated traversely to provide further interlocking between the lengths of wire in the plies thereof. Corrugating the fabric is known in the art as "crimping" and the product is commonly called "crimped knitted wire mesh fabric". The tube may be corrugated at a right angle to its axial length or at a different angle, e.g. 45°, as disclosed by U.S. Pat. Nos. 2,334,263 and 2,680,284.

The formed element 6 consists of a compressed mass of metal wire characterized by a closely packed, interlocked wire structure that forms a coherent body. In this connection it is to be noted that as the convoluted body of knitted wire mesh fabric is compacted and molded into the element 6, it is tightly compressed in directions transverse to the width of the flattened tube or ribbon, i.e. it is compressed both radially and axially, with the result that the turns or lengths of wire are crimped at innumerable points beyond their elastic limits so that they take a more or less permanent set. Additionally as the wire mesh fabric is compressed the wire is so deformed as to produce a compressed mass or body consisting of a very great number of uniformly distributed, randomly directed, relatively short spans or lengths of wire which contact each other at innumerable points within the mass, with the result that these spans or lengths are intimately interlocked substantially uniformly throughout the entire volume of the mass with portions of the spans of wire being spaced to form small pockets and passageways of capillary size. The net result is a relatively dense yet porous cohesive or self-supporting body consisting of fine, intermingled and interconnected spring wire spans and characterized by substantial structural integrity, controlled density, a uniform and fine porosity, and a controlled spring constant. The multiplicity of short spans of wire, the uniformity of distribution, the directions of such spans, the innumerable points of contact between them, and the fact that the short spans of wire have an inherent spring action and are capable of slight movement relative to the other spans which they contact, all contribute to the noise-reducing capability of element 6.

Turning again to FIGS. 1–3, the element 6 is made so that its outside diameter is only slightly smaller than counterbore 16 but larger than counterbore 14, whereby shoulder 18 can function as a seat for one end of the element. The inner diameter of element 6 preferably is made smaller than that of bore 12. While the inner diameter of element 6 may be greater than that of bore 12, better results are achieved if it is equal to or less than the bore diameter. The cap member is fitted on the noise-reducing element so that the opposite end of the latter is engaged by end wall 24 of the cap member. The cap member is disposed so that its legs extend along slots 20 and is secured in place by bending the ends of its legs around and under the annular end surface 50 of the retainer section of bushing member as shown at 52 in FIGS. 2 and 3. As an alternative measure the legs may be secured to the retainer section of the bushing by staking, e.g. by deforming the outer surfaces of the retainer section at opposite sides of slots 20 so that portions of said surfaces extend over and frictionally grip the legs of the cup member. As a further alternative, legs 26 could be secured to the bushing by welding, or brazing or by means of a suitable cement such as an epoxy resin cement. Regardless of how the cap member is secured to the bushing member, the opposite ends of noise-reducing element 6 are engaged by the end wall of the cap member and the flat annular shoulder 18 of the bushing member so that it cannot move axially. Preferably also the cap member and bushing exert just enough axial pressure on the element 6 to prevent it from moving laterally. However, this is not absolutely necessary since the cylindrical wall 22 of the cap member and the surrounding wall portion of the bushing in the region of its counterbore 16 inhibit lateral movement of element 6.

Figure 2:
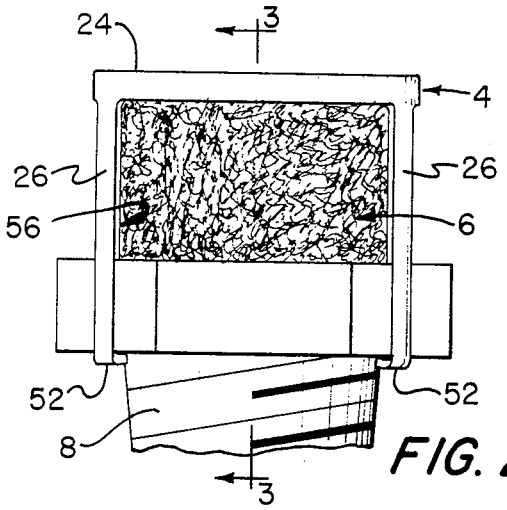
FIG. 2 is a side elevation of the fluid exhaust silencer made by combining the components shown in FIG. 1.

As can be seen from FIGS. 2 and 3, when the device is assembled, the counterbore 14 forms a circular chamber 54 between bore 12 and the adjacent end of noise-reducing element 6. Additionally the three spaces between legs serve as exit openings or orifices 56 for whatever fluid is introduced to the device via bore 12. Assuming that the bushing member is attached to apparatus discharging a fluid at high pressure, e.g. a conduit 58 leading to the exhaust port of an air valve or air cylinder, the discharged fluid will pass through bore 12 into chamber 54 and the center passageway 60 defined by the inner surface 30 of element 6. Some of the fluid will pass from chamber 54 directly into the adjacent end of element 6, while the remainder will pass into element 6 via its inner surface 30. The fluid passes through the element 6 and exits via the apertures 56. As the fluid passes through the wire mesh element it is broken up into a myriad of minute air streams which are distributed uniformly through the element and exit the device in an omni-directional pattern. Due to the nature of the element 6, the fluid exits the device at a relatively low and acceptable noise level. The omni-directional pattern of discharge results from the fact that the fluid exits the device through all of the outer cylindrical surface 32 of element 6 except for those portions that are obstructed by the adjacent end of the bushing member and the cylindrical wall 22 and legs 26 of the cap member.

By way of example, a device made as shown in FIGS. 1–3 was tested for its silencing capability. The device had a noise-reducing element made from a knitted metal wire mesh tube that was flattened to form a 2-ply ribbon which was convoluted and compressed as hereinabove described. The wire mesh fabric tube was made of round 0.0045 inch diameter stainless steel wire and had about 9 loops per inch. The noise-reducing element had a density of about 40%, an inner diameter of about 0.38 inch, an outer diameter of about 1.00 inch, and an overall length of about 0.625 inch. The bore 12 in bushing 2 had a diameter of about 0.44 inch and the diameter and axial length of chamber 54 were about 1.02 and 0.12 inch respectively. Cap member 4 had three equally spaced legs each having a width of about 0.125 inch. The device was connected to a 100 psi air supply and the noise level was measured with a precision sound level meter with the microphonic pickup located about 3 feet away from the device. The sound level was found to be 78 dBA and the flow through the device was about 49 SCFM. By way of comparison, the sound level of 100 psi air discharged from an open 7/16 inch pipe at a rate of 49 SCFM measures about 97 dBA. The device was found to produce a back pressure of only about 6 psi. It is believed that the remarkably low noise level at which air is discharged from such a device is due to the fact that the incoming turbulent air is transformed or modified into a laminar or nearly laminar flow by the noise-reducing element 6.

As an alternative mode of construction nozzles according to the present invention, the ribbon formed by flattening the knitted wire mesh fabric tube may be first folded along fold lines extending transversely of its length before being rolled up and molded as previously described.

Exhaust silencers made with elements formed of other muffling materials tend to generate more noise and higher back pressures. Surprisingly exhaust silencers with elements made in the manner described above but formed of conventional wire screen or cloth provide substantially less noise reduction. It is to be noted that the terms "wire screen" and "wire cloth" are synonymous and denote a material consisting of a first series of wires running in one direction and a second series of wires running at right angles to the first, with each wire in the first series alternately passing over and under successive wires of the second series.

The bushing and cup members are preferably made of steel or aluminum, but also may be made of other metals and alloys and may even be made of a plastic or fiber reinforced plastic material, e.g., an epoxy resin or polypropylene.

Although the preferred embodiment of the invention herein described comprises a flow-modifying element 6 made of a 2-ply ribbon of knitted wire mesh fabric, it is to be understood that a single ply ribbon may also be used. Also, more than two plies can be wound up to form a body which is molded by compaction into a suitable flow-modifying element. Further knitted fabric having more or less than 9.0 loops/inch may be used. It also is contemplated that the knitted fabric may be knitted from multiple strand wire, e.g., from two wire strands twisted together to form a single wire.

A further possible modification is to form bushing member 2 without counterbore 14, i.e. so that as to omit chamber 54 and have bore 12 continue without increase in size up to the lower end of noise-reducing element 6. In such case bore 12 may but need not be the same size as the inner diameter of element 6. In this connection it is to be noted that the resistance to air flow is less radially than it is axially through element 6 due to the manner in which the element is made. It also has been determined that the reduction in noise level becomes less as the inner diameter of element 6 increases (without a corresponding increase in its outer diameter) relative to the diameter of bore 12. Hence to increase throughput without increasing the noise level it is preferred to increase the length of element 6 rather than increasing its inner diameter.

It is to be understood also that the cap member and bushing could be formed so that legs 26 are integral extensions of bushing 2 and the cap member consists merely of end wall 24 and side wall 22, with the legs being attached to the end cap in the same manner suggested herein for attaching them to the bushing during assembly of the device. It also is appreciated that the retainer section of the bushing could be formed with a cylindrical annular extension and the cap member could be formed with a circular ring connecting the lower ends of its legs, with the annular extension and ring being adapted to be locked to each other, e.g. by screw threads, to hold element 6 in place. Another possible modification is to form the end cap with only two legs disposed in diametrically opposed relation to one another, or with more than three legs. Also, if desired, the device could be made with two concentric noise-reducing elements 6 with an annular space separating the two elements. Still other modifications will be obvious to persons skilled in the art which do not depart from the principles of the invention herein stated.

The present invention is not limited to gases and may be used to provide noise-silencing liquid discharge devices. Therefore, in the following claims the term "fluid" is to be construed as embracing both gases and liquids.

As is believed obvious from the foregoing description, the invention provides exhaust silencers which are relatively inexpensive and easy to manufacture and install, durable, capable of reducing exhaust noise to below legally acceptable levels, and have a high through-put so as not to cause a slow-down in the equipment to which they are attached.

I claim:

1. A fluid exhaust silencer device comprising:

a first member adapted to be connected to a fluid exhaust, said first member having a bore therethrough with an inlet for receiving fluid from said exhaust;

a tubular noise-reducing element made up of a knitted metal wire mesh fabric that has been convoluted and compressed into a self-supporting, dense, porous mass with the wire threads of said fabric oriented randomly in said mass and forming capillary-sized passageways; and a second member comprising a plurality of spaced legs attached to said first member with said noise-reducing element clamped between them;

said tubular noise-reducing element having an inner surface and being aligned with said bore so that fluid can pass from said bore to the inner surface of said element;

said plurality of spaced legs defining apertures at the outer surface of said element whereby fluid can flow radially through said element and exit said device via said apertures.

2. A device according to claim 1 wherein said first member is formed with a radially extending surface, and said legs are bent so as to engage said radially-extending surface.

3. A device according to claim 1 wherein said first member comprises a plurality of slots, and each of said legs is disposed in one of said slots.

4. A fluid exhaust silencer device comprising:

a bushing member having a first section adapted to be connected to a fluid exhaust means, a second retainer section formed with an annular seat, and a bore extending longitudinally through said bushing for introducing fluid to said device from said fluid exhaust means;

a self-supporting, dense, fluid-permeable, noise-reducing element made from a knitted metal wire mesh fabric with the wire threads of said fabric oriented randomly in said element, said noise-reducing element being tubular and comprising an inner longitudinally extending surface, an outer longitudinally extending surface, and first and second annular opposite end surfaces, and a cap member having an end wall and a plurality of mutually spaced legs extending away from said end wall;

said noise-reducing element being located between said bushing member and said cap member with said first end surface in engagement with said seat and said second end surface in engagement with said end wall;

said legs extending along the outer longitudinally extending surface of said noise-reducing element and being secured to said bushing member so as to hold said noise-reducing element captivated between said cap member and said bushing member;

said noise-reducing element being disposed relative to said bushing member so that fluid introduced to said bore from said fluid exhaust means can flow into said element via said inner surface and exit said element via said outer surface.

5. A device according to claim 4 wherein said noise-reducing element is cylindrical.

6. A device according to claim 4 wherein said legs define exit apertures whereby fluid can flow out of said outer surface of said noise-reducing element.

7. A device according to claim 4 wherein said first section is threaded for connecting said bushing member to said fluid exhaust means and said bushing member is adapted for engagement by a tool for turning said bushing member so as to make a screw connection to said fluid exhaust means.

8. A fluid exhaust silencer device comprising:

a first member adapted to be connected to a fluid exhaust, said first member having a bore therethrough with an inlet for receiving fluid from said exhaust;

a tubular noise-reducing element having two opposite ends and an inner surface and being made up of a knitted metal wire mesh fabric that has been convoluted and compressed into a self-supporting, dense, porous mass with the wire threads of said fabric oriented randomly in said mass so as to form capillary-sized passageways in said element; and a second member attached to said first member with one of said opposite ends of said element engaged by said first member and the other of said opposite ends engaged by said second member, said first and second members coacting to hold said noise-reducing element between said members and substantially aligned with said bore so that fluid can pass from said bore to the inner surface of said element;

said first member including a chamber for providing fluid communication between said bore and said element, said chamber being disposed so as to permit fluid to flow from said bore into said element via said one opposite end thereof as well as via said inner surface;

at least one of said first and second members having means defining apertures at the outer surface of said element whereby fluid can flow radially through said element and exit said device via said apertures.

9. A device according to claim 8, wherein the diameter of said inner surface of said tubular noise-reducing element is smaller than the diameter of said bore of said first member.

10. A device according to claim 8 wherein said element is a cylinder and said opposite ends are the annular ends of said cylinder.

* * * * *